US005077953A

United States Patent [19]

Seccombe

[11] Patent Number: 5,077,953

[45] Date of Patent: Jan. 7, 1992

[54] STRUCTURAL SPACER

[75] Inventor: Campbell J. Seccombe, Normanhurst, Australia

[73] Assignee: John Lysaght (Australia) Limited, Sydney, Australia

[21] Appl. No.: 508,715

[22] Filed: Apr. 16, 1990

[30] Foreign Application Priority Data

Apr. 18, 1989 [AU] Australia ..... 33129/89

[51] Int. Cl.[5] ..... E04C 2/42; E04C 3/02

[52] U.S. Cl. ..... 52/696; 52/667

[58] Field of Search ..... 52/696, 667, 668, 669; 403/219

[56] References Cited

U.S. PATENT DOCUMENTS

| | | | |
|---|---|---|---|
| 893,815 | 7/1908 | Schutt | 52/696 |
| 1,165,049 | 12/1915 | White | 403/219 |
| 2,695,083 | 11/1954 | Wolf | 52/696 |
| 2,873,828 | 2/1959 | Zitomer | 402/219 |
| 4,840,005 | 6/1989 | Cochrane | 52/667 |

FOREIGN PATENT DOCUMENTS 579896 10/1986 Australia .

16593/88 1/1988 Australia .

*Primary Examiner*—James L. Ridgill, Jr.

*Attorney, Agent, or Firm*—Armstrong, Nikaido, Marmelstein, Kubovcik & Murray

[57] ABSTRACT

A structural spacer adapted to bridge between two stringers each comprising a web pierced by a pair of slots of predetermined size comprises a steel channel-sectioned body (10) with pressed metal end fittings (11,19) at each end. One end fitting (19) includes two projecting, relatively small hooks (24) with arcuate outer surfaces (25), adapted to respectively engage an edge of the slots. The other end fitting has two relatively larger hooks (14) with arcuate inner surfaces (15) adapted to enter the respective slots and engage over the small hooks of a second spacer engaged therewith. The depths of the large hooks progressively increase from a minimum at their tips, so that when the spacer is swung into the operative position, but not before, the two hooks extending through each slot substantially fill it. An abutment (18) on the end fitting with the larger hooks determines the extent to which the spacer may be swung as aforesaid.

6 Claims, 3 Drawing Sheets

STRUCTURAL SPACER

FIELD OF THE INVENTION

This invention relates to structures of the kind comprising an array of spaced apart, parallel longitudinal members (referred to as stringers hereinafter) and a plurality of members (referred to as spacers hereinafter) bridging from stringer to stringer, wherein the spacers are arranged end to end in spaced apart, parallel rows extending transversely of the stringers, so that the entire structure is in the form of a rectangular grid.

More particularly the invention relates to the spacers of such a structure.

Typically the stringers may be Z sectioned purlins of a roof, channel or hat sectioned studs of a wall frame, I sectioned joists of a floor support or other rolled or extruded metal members comprising a web and one or more flanges. The spacers extend effectively from web to web of the stringers.

DESCRIPTION OF THE PRIOR ART

Hitherto the affixture of the spacers to the stringers has usually called for a good deal of on-site work such as welding, bolting or riveting, even when standardised prefabricated components have been used.

In attempts to reduce the on-site work various connector devices and joint formations have been proposed. These have not been generally satisfactory, as some have required special additional components, some have still required some on-site work, for example the bending over of locking tabs, and others, though free of those defects, have not provided a sufficiently positive or movement-free connection between the members.

SUMMARY OF THE INVENTION

An object of the present invention is to provide a spacer having end formations, preferably formed in cheap, pressed metal end fittings, enabling two spacers to be each simply hook-engaged with the stringer web through a slot in the web without mutual hindrance, but such that when the spacers are swung into alignment each is secured firmly in place by the other.

The invention consists in a structural spacer adapted to bridge between two stringers each comprising a web pierced by a slot of predetermined size, said spacer comprising an elongate body, a small hook at one end of said body adapted to extend through, and engage over an edge of, a said slot and then present an outer surface as an edge of a slot remainder, a large hook at the other end of the body adapted to extend through a said slot, having an inner surface adapted at a working position to bear upon the outer surface of the small hook of an identical spacer, and having a depth at said working position which is substantially equal to the depth of a said slot remainder, and abutment means adapted to contact the web of a said stringer through which said large hook projects when said working position coincides with the web of that stringer and said body is substantially normal thereto.

In preferred embodiments the outer surface of the small hook and the inner surface of the large hook are mating arcuate surfaces to provide a substantial bearing area therebetween and facilitate the rotation of the large hook about the small hook to bring its working position into coincidence with the web of the stringer.

Furthermore, for preference the depth of the large hook is less at its tip than it is at its working position. This facilitates the insertion of the large hook into the slot remainder by reducing the angle of inclination at which the spacer has to be presented to the web of the spacer to insert the tip of the hook. Thus, in preferred instances wherein the outer surface of the small hook is arcuate, the outer surface of the large hook may also be arcuate, but not concentric with its arcuate inner surface, so that the change in hook depth is progressive, to provide a cam-like tightening action as the large hook is turned to bring its working position into coincidence with the web.

DESCRIPTION OF THE PREFERRED EMBODIMENT

Figure 1:
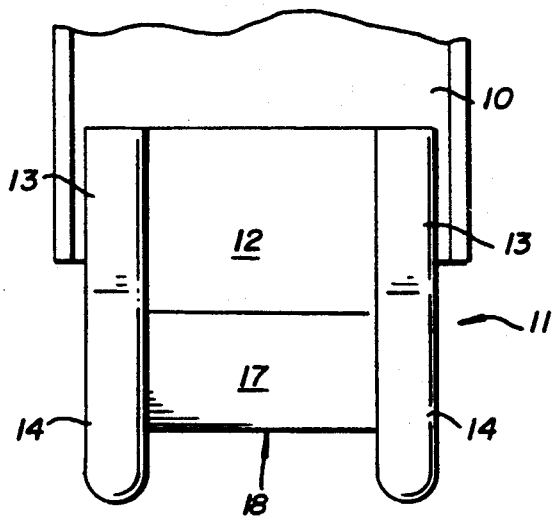
FIG. 1 is plan view of an end portion of a structural spacer according to the invention.
Figure 2:
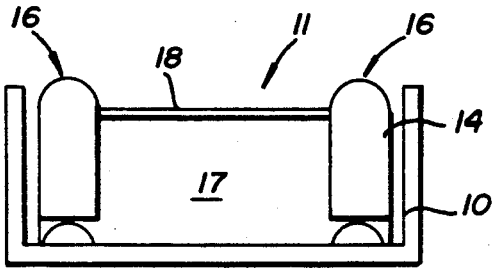
FIG. 2 is an end view of the end portion of FIG. 1.
Figure 3:
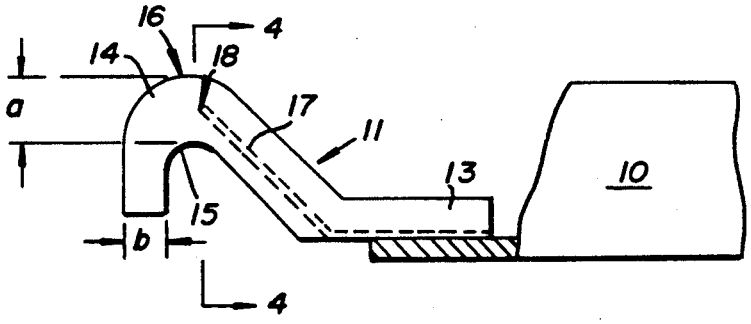
FIG. 3 is a partly sectioned side view of the end portion of FIG. 1.
Figure 4:
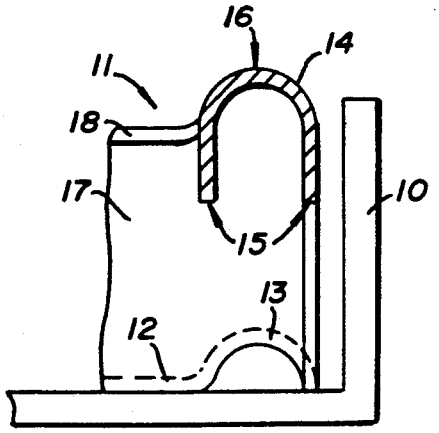
FIG. 4 is a sectional view taken on line 4—4 of FIG. 3 drawn to a larger scale.

FIGS. 1 to 4 illustrate an end portion of a spacer comprising an elongated sectioned body 10 and a pressed metal, large hook end fitting 11.

The end fitting 11 comprises an affixture plate 12 with stiffening edge ribs 13 which merge into U-sectioned large hooks 14 projecting longitudinally of the spacer from the plate 12.

The end fitting 11 is fixed to the body 10. For example, the plate 12 may be welded or riveted to the web of the body 10. Alternatively the large hooks 14 may be integral extensions of the body web.

It should be noted that each of the large hooks 14 has paired inner surfaces 15 of arcuate (in this instance semicircular) shape and an outer surface 16 also of arcuate shape. The outer surface 16 is not concentric with the inner surfaces 15 so that the hook 14 has a continuously increasing depth over at least a part of its curved portion. In particular dimension "a", being the depth of the hook at its working position, is greater than dimension "b", being the depth at its tip.

It should also be noted that the affixture plate 12 has an inclined extension 17 between the large hooks 14 terminating in an abutment surface 18 extending from one hook to the other. The relevance of the increase in hook depth from "b" to "a" and the presence of the abutment surface 18 will be made clear hereinafter.

Figure 5:
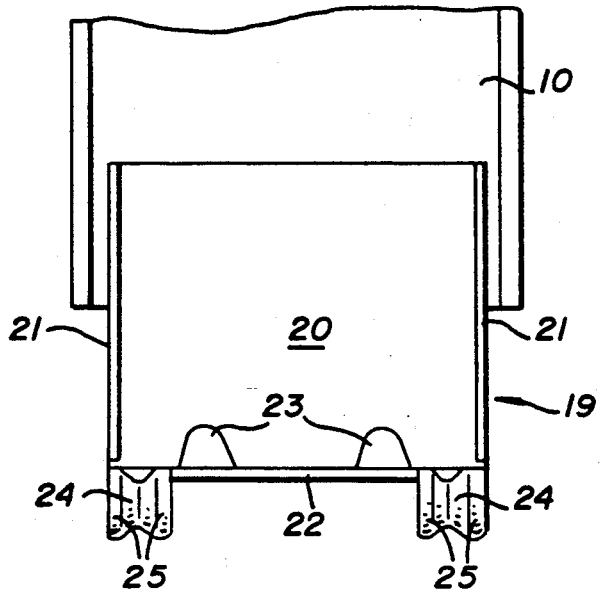
FIGS. 5 to 7 are views similar to FIGS. 1 to 3 respectively of the opposite end portion of the same spacer.
Figure 6:
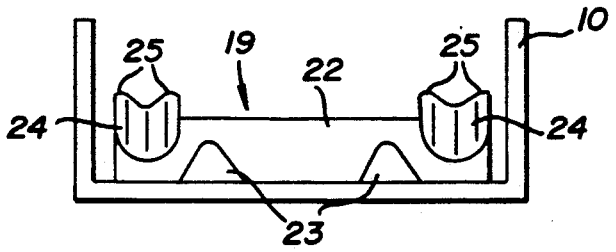
Figure 7:
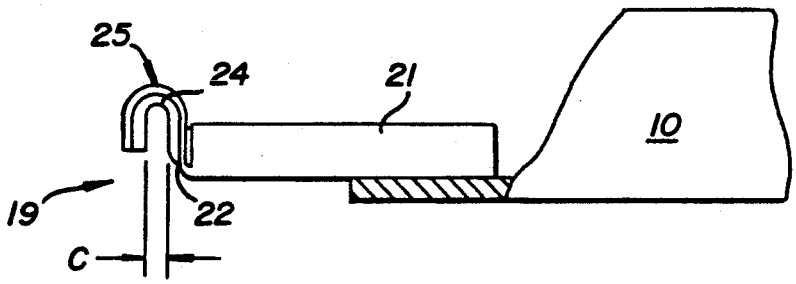

By reference to FIGS. 5 to 7, it will be seen that the opposite end of the body 10 has a small hook end fitting 19 fixed to it. The end fitting 19 comprises an affixture plate 20, with edge flanges 21, a front flange 22 and stiffening gussets 23 for the front flange 22. The front flange 22 extends into two curved small hooks 24.

The dimension "c" between the limbs of the generally U-shaped small hooks 24 is substantially equal to, preferably very slightly more than, the thickness of the web of a stringer with which the illustrated spacer is intended to be used. Thus the small hooks 24 are adapted to neatly engage the edge of a slot in such a stringer and then present paired outer curved surfaces 25 as an edge of the remainder of that slot.

The outer curved surfaces 25 of the small hooks 24 have substantially the same diameter and spacing as the inner curved surfaces 15 of the large hooks 14, thus the inner surfaces 15 of one spacer may snugly encompass the outer surfaces 25 of a second spacer and rotate thereon about an axis extending transversely of the longitudinal direction of both such spacers.

Figure 9:
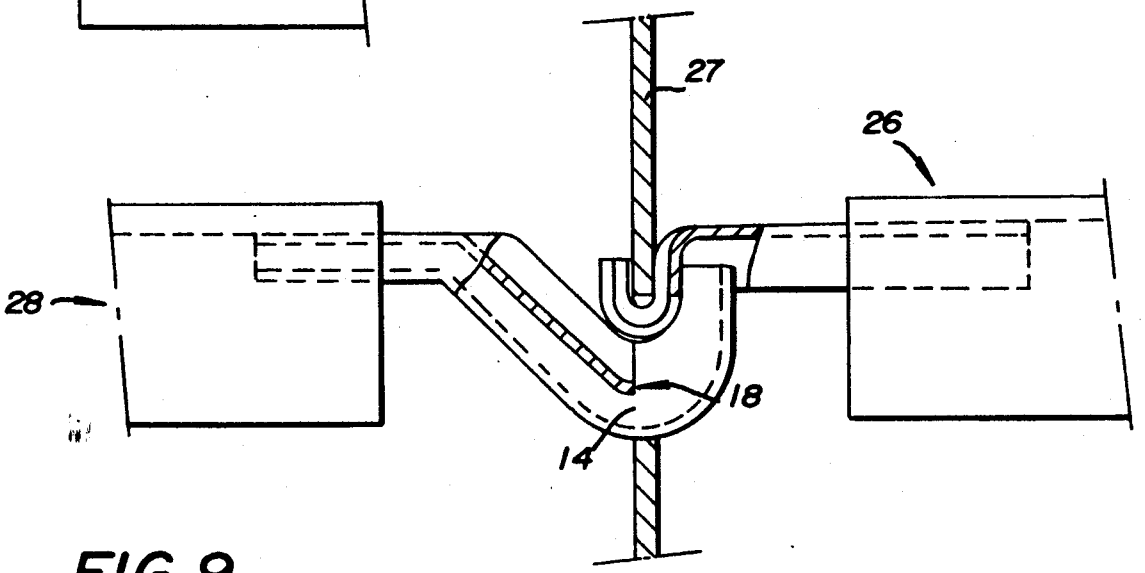
FIG. 9 is a view similar to FIG. 8 showing the two spacers fully engaged with the web.
Figure 8:
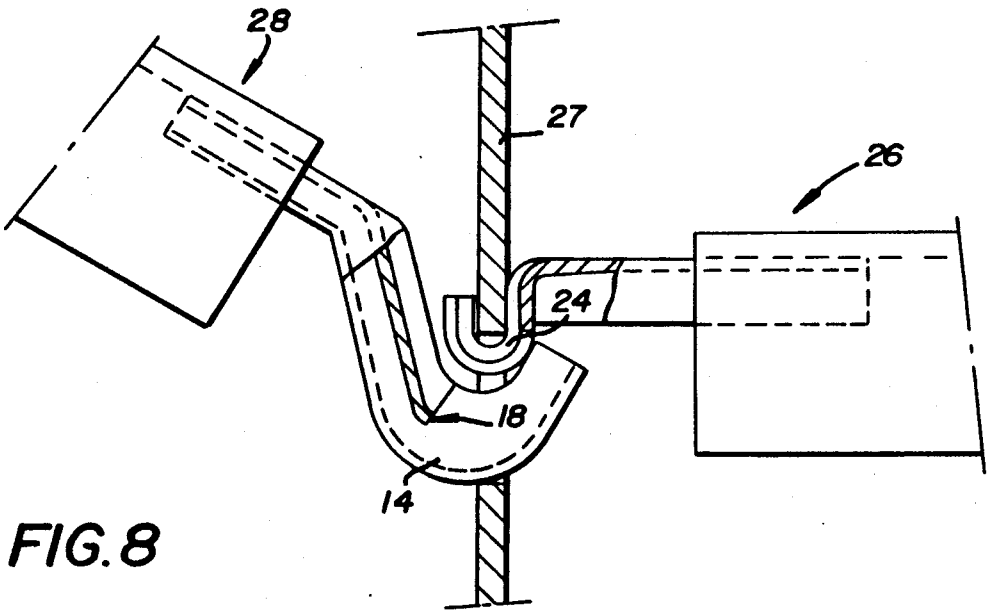
FIG. 8 is a partly sectioned side view of opposite end portions of two spacers according to the earlier figures being engaged with a web of a stringer.

FIGS. 8 and 9 show how spacers according to FIGS. 1 to 7 co-operate. In FIG. 8 a first spacer 26 is shown with its small hook 24 engaged about the edge of a slot in a web 27 of a stringer. Two such slots are provided corresponding in position to the two small hooks 24 of the spacer.

A second spacer 28 disposed in an inclined manner has had the tip of its large hook 14 inserted loosely through the same slot. The spacer 28 may then be moved bodily slightly to bring the inner curved surfaces of its large hooks 14 into respective contact with the outer curved surfaces of the small hooks 24 of spacer 26, following which the spacer 28 may be rotated into the normal position shown in FIG. 9. As a result of that rotation, and because of the progressive increase in depth of the large hooks, the initial loose engagement of their tips within the slots is converted to a firm engagement wherein at the working position of maximum hook depth (dimension "a" of FIG. 3) the hooks 14 substantially fill the remainders of the respective slots. Further rotation is prevented by the abutment surface 18 coming into contact with the web 27 between the two slots therein.

As the spacer 28 is rotated as aforesaid the small hooks on its left end (not seen in the figures) come into contact with the web of an adjacent stringer and spring it aside sufficiently to permit the small hooks to snap into position about the edge of the coacting slot in that stringer's web. In practice this may be done manually with little difficulty because the angle between the spacer and the stringer at that time ensures that a small force applied to the spacer in its transverse direction results in a large force in the longitudinal direction tending to spring the stringers apart.

Thus once the two spacers are in position as shown in FIG. 9, spacer 26 cannot move to the left or right because of its small hook's direct engagement with the web 27, spacer 28 cannot move to the left because of its large hook's engagement over the small hook of spacer 26, it cannot move to the right or rotate further because of the contact of its abutment surface 18 with the web 27, and neither spacer end can move up or down (as seen in the figures) because their hooks together substantially fill the slot. That is to say the spacers are effectively fixed tightly to the stringer without need for any on-site work or special tools.

Of course the outer ends of the endmost spacers in each row of spacers have to be fixed by other means because of the absence of a further co-operating spacer, but this may be effected in any convenient conventional manner.

I claim:

1. A structural spacer sized to bridge between two stringers each comprising a web pierced by a slot of predetermined size, said spacer comprising:

an elongate body, a small hook at one end of said body sized to extend through, and engage over an edge of, a said slot and then present an outer surface as an edge of a slot remainder, a large hook at the other end of the body sized to extend through a said slot, having an inner surface sized wherein said inner surface bears upon the outer surface of the small hook of an identical spacer at a working position, and having a depth at said working position which is substantially equal to the depth of a said slot remainder, and abutment means integral with the large hook and sized to contact the web of a said stringer through which said large hook projects when said working position coincides with the web of the stringer and said body is substantially normal thereto.

2. A spacer according to claim 1 wherein the outer surface of the small hook and the inner surface of the large hook are mating arcuate surfaces.

3. A spacer according to either claim 1 or claim 2 wherein the increase in depth of the large hook from its tip to its working position is smoothly progressive.

4. A spacer according to claim 1 or 2 comprising a body and two pressed metal end fittings fixed to said body; said hooks being formed in said end fittings.

5. A spacer according to claim 1 or 2 having a plurality of said small hooks at said one end.

6. A spacer according to claim 5 having a like plurality of said large hooks at said other end.

* * * * *